United States Patent [19]

Zecman

[11] Patent Number: 4,886,107

[45] **Date of Patent: * Dec. 12, 1989**

[54] PISTON FOR COLD CHAMBER

[76] Inventor: Kenneth P. Zecman, P.O. Box 39009, Redford, Mich. 48239

[ * ] Notice: The portion of the term of this patent subsequent to May 26, 2004 has been disclaimed.

[21] Appl. No.: 50,786

[22] Filed: May 18, 1987

Related U.S. Application Data

[63] Continuation-in-part of Ser. No. 834,590, Feb. 28, 1986, Pat. No. 4,667,729.

[30] Foreign Application Priority Data

May 15, 1986 [CA] Canada ..... 509306

[51] Int. Cl.[4] ..... B22D 17/10; B22D 17/20

[52] U.S. Cl. ..... 164/113; 164/312

[58] Field of Search ..... 164/113, 120, 312, 314

[56] References Cited

U.S. PATENT DOCUMENTS

| | | | |
|---|---|---|---|
| 2,932,865 | 4/1960 | Bauer | 164/113 |
| 3,300,822 | 1/1967 | Thompson | 164/312 |
| 3,613,768 | 10/1971 | Awano et al. | 164/120 |
| 3,901,306 | 8/1975 | Miki et al. | 164/312 |
| 4,334,575 | 6/1982 | Miki et al. | 164/113 |
| 4,667,729 | 5/1987 | Zecman | 164/312 |

FOREIGN PATENT DOCUMENTS

| | | | |
|---|---|---|---|
| 57-68257 | 4/1982 | Japan | 164/312 |
| 61-289955 | 12/1986 | Japan | 164/312 |
| 1225680 | 4/1986 | U.S.S.R. | 164/312 |
| 1266652 | 10/1986 | U.S.S.R. | 164/312 |

*Primary Examiner*—Richard K. Seidel
*Assistant Examiner*—J. Reed Batten, Jr.
*Attorney, Agent, or Firm*—Krass and Young

[57] ABSTRACT

An improved shot tip for a metal injecting shot sleeve wherein the rear end of the shot tip is of a reduced diameter as compared to the front end of the shot tip so as to minimize drag as the shot tip moves through the shot sleeve, and a wear resistant ring is positioned in an external groove in the enlarged diameter front end portion of the shot tip to minimize wear and preclude blowby of molten metal at the reduced length interface between the shot tip and the shot sleeve.

18 Claims, 4 Drawing Sheets

PISTON FOR COLD CHAMBER

RELATED APPLICATION

This application is a continuation-in-part of patent application Ser. No. 834,590, filed on Feb. 28, 1986, now U.S. Pat. No. 4,667,729.

BACKGROUND OF THE INVENTION

This invention relates to apparatus for injecting molten metals into a mold cavity, said apparatus being commonly referred to as a "cold chamber," and more particularly to an improved "shot tip" which serves as the plunger or ram in the injection apparatus.

It is well-known that molten metals such as aluminum, zinc, magnesium and other metals and alloys of same can be injected into a mold cavity by means of a device known as a cold chamber. This well-known device comprises a cylindrical sleeve having a through bore which is adapted to receive a plunger or "shot tip." The sleeve is provided with a radial opening called a "well" through which the molten metal is introduced to the interior bore of the sleeve or chamber. After the metal has been introduced and accumulated in sufficient quantity, power means are activated to drive the shot tip forward, injecting plunger-fashion the molten material into the mold cavity.

Cold chambers or shot sleeves and particularly shot tips operate in an extremely hostile environment as far as thermal strain and wear is concerned. Accordingly, the devices typically exhibit a short life span.

One of the principal problems giving rise to the short life of the prior art shot tip is the extreme heat experienced by the face of the shot tip, that is, that portion of the shot tip which comes into contact with the injected molten metal. Cooling is attempted by hollowing out the shot tip and creating a coolant water conduit axially into and out of the hollow area. However, it is believed that the prior art arrangement which involves pumping water through a central tube and exhausting around the outside of the tube is inefficient because the coolant water experiences a dramatic temperature rise and vaporization as it emerges from the tube and impacts the extremely hot front wall or face of the shot tip. When vaporization occurs, the pressure within the cooling chamber increases to the point where it is greater than the line pressure of the water and, at least for an instant, the flow of coolant is interrupted or slowed. Moreover, inefficient flow within the hollow chamber results in much of the water passing through without carrying heat away. High heat causes thermal expansion and inordinate wear on the leading edge of the piston.

In applicant's copending U.S. application Ser. No. 834,590, filed Feb. 28, 1986, of which this application is a continuation-in-part, an improved shot tip design is disclosed and claimed comprising a head which has formed therein an internal chamber to receive coolant through a passage defined by the radial space between the outer surface of an outlet tube and the inner diameter of a bore in the shot tip head. Means are provided to cause the coolant to follow a smooth flow path around the chamber and into the tube end in such a fashion to drastically improve the rate at which heat is carried away from the face or leading edge of the piston. The shot tip is formed with an undercut or shoulder defining a narrow forward facing annular step surface a substantial distance longitudinally back from the nose of the shot tip such that the majority of the molten metal contacts the nose surface. This, in effect, makes the large area and large volume nose portion a heat sink which results in the cylinder-contacting peripheral surface adjacent the shoulder being cooler and less susceptible to wear producing thermal expansion. The shot tip of this copending application exhibits a number of major changes as compared to industry standards.

Firstly, the coolant or water is pumped into the piston in reverse fashion. Instead of pumping water into the piston by a copper tube, the flow is altered and the water is exited via the copper tube. This means that the water then enters the piston via a hole in the plunger rod or actuating rod. Since the copper tube is concentric with the hole in the rod, the water enters the piston through the area between the wall of the inner diameter and the copper tubing.

Secondly, the copper tube protrudes into the piston from the plunger rod. Because the water path is reversed as explained above, a baffle can be attached on the end of the tubing to control not only the flow path of the water but also its velocity through the piston by varying the size of the baffle. By increasing the size of the baffle, the area through which the water passes is decreased, thereby increasing the water's velocity. It has already been determined that to achieve optimum cooling from the circulating water, it should travel at a rate close to 10 feet/per second. It must also contact as much surface area as possible of the object intended to be cooled. To help direct the water out of the piston, a deflector is provided which is mounted on the end of the baffle. The deflector directs the hot water or steam back through the inner diameter of the baffle and into the copper tube which is attached to the baffle.

Thirdly, the flow path of the water is such that it will reach the hottest part of the piston directly in front of the exhaust hole leading into the copper tubing. If the water is heated to its flash point, the steam that is formed will not interfere with the incoming water supply. In fact, when steam is passed in the copper exhaust tube, the incoming water which surrounds the copper tube will condense the steam and form a vacuum. This vacuum creates a syphon effect which pulls the water along to replace the vacuum. This system ensures that any increase in volume produced by the creation of steam will not form a back pressure and prohibit or slow the flow of water through the piston.

Fourthly, even though the rate at which the piston is cooled has been increased, it is still impossible to eliminate high heat (1250 degrees Fahrenheit) across the entire face of the piston. Therefore, an undercut is incorporated bringing the leading edge of the cylinder contacting portion of the piston back along the diameter. For example, the shot tip may be undercut 0.625 inches and as much as 1.0 inches. The object of this undercutting is to bring the water cavity forward in the piston, increasing the surface of the tip nose which contacts the molten metal, causing this nose to act as a heat sink and reduce radial expansion in the part of the tip which slides against the cylinder wall. The advantage of this design is that expansion across the diameter at the point of the leading edge which must seal against the sleeve can be better controlled. This expansion control greatly improves tip life since excessive wear caused by the expansion of the piston against the shot sleeve wall is the primary cause of tip failure.

The present invention may be utilized alone or to even greater advantage in combination with the invention of Ser. No. 834,590 to address the problem of reducing tip wear and tip failure due to a tendency of the tip to hang up or drag along the walls of the sleeve under certain circumstances.

The drag problem occurs primarily because the sleeve tends to warp into a curved configuration as a result of the heat of the molten metal being primarily transferred to the bottom of the sleeve; i.e., when hot metal enters the sleeve, the bottom of the sleeve expands at a much greater rate than the top of the sleeve, forcing the sleeve to warp. This warpage is greatest immediately beneath the pour hole in the sleeve because the greatest amount of heat is transferred through the sleeve at that point and because the pour hole above this hot spot offers less resistance to the expanding bottom so that a defined bend occurs at the pour hole and this bend often causes the shot tip to hang up or drag in the sleeve as it traverses the area of the pour hole.

SUMMARY OF THE INVENTION

This invention is directed to the provision of shot tip which retains the durability advantages of the shot tip of Ser. No. 834,590 and which minimizes drag as between the shot tip and the shot sleeve.

According to an important feature of the invention, the head includes a main body section having a generally cylindrical configuration with a front end portion of relatively large diameter forming a relatively tight fit with the shot sleeve and a rear end portion of relatively small diameter forming a relatively loose fit with the shot sleeve. This arrangement minimizes the surface in engagement with the shot tip and allows the shot tip to move smoothly and efficiently through the shot sleeve without binding or dragging.

According to a further feature of the invention, the head further includes means forming a ring around the front end portion of the main body section and the ring is formed of a wear resistant material different from the material of the main body section. The relatively hard ring member at the forward end of the shot tip resists wearing at the shot tip/sleeve interface and thereby precludes blowby of molten metal that might otherwise occur at this interface as a result of reducing the axial length of the interface to address the drag problem.

The invention shot tip design is especially effective when used in combination with the cooling arrangement employed in the shot tip of Ser. No. 834,590. Specifically, the wear resistant ring of the invention shot tip is preferably positioned right over the primary chill zone on the shot tip as provided by the cooling means of Ser. No. 834,590 so that the size of the ring at the sealing interface with the shot tip is held substantially constant so that the ring will not expand outwardly and bind against the sleeve. In one embodiment of the invention, the main body section of the shot tip is formed of a soft, highly conductive material, an external circumferential groove is formed in the front end portion of the main body section, and the ring comprises a ring member of relatively hard material positioned in the groove in generally flush relation to the surrounding surface of the front end portion. This arrangement provides an efficient means of minimizing the axial interface as between the head and the shot sleeve while resisting wear at the interface to avoid blowby of molten metal.

According to a further feature of this embodiment of the invention, the main body section is formed of pure copper and the ring member is formed of steel. This arrangement allows a steel ring to be utilized as the relative hard wear resistant member and allows essentially pure copper to be utilized in the main body section of the shot tip in place of the beryllium copper commonly employed as the shot tip material. The cost of pure copper is only a fraction of the cost of beryllium copper, and pure copper provides better heat conductive properties than beryllium copper.

In another embodiment of the invention, the head further includes a front end section; the front end section is secured to the main body section by a circumferential weld ring; and the circumferential weld ring comprises the ring of wear resistant material. This arrangement provides a further efficient means of providing a wear resistant ring at the small axial interface between the head of the shot tip and the shot sleeve. In the commercial form of this embodiment of the invention, the main body section is formed of steel, the front end section is formed of copper, and the weld ring is formed of a copper alloy. The two piece construction of this embodiment of the invention also provides substantial economy in construction and permits the head to be readily reconstructed after it wears out. The two piece construction of this embodiment of the invention also allows the cooling chamber within the head to be designed in a manner to optimize the flow of the coolant fluid within the head.

DETAILED DESCRIPTION OF THE ILLUSTRATIVE EMBODIMENTS

Figure 1:
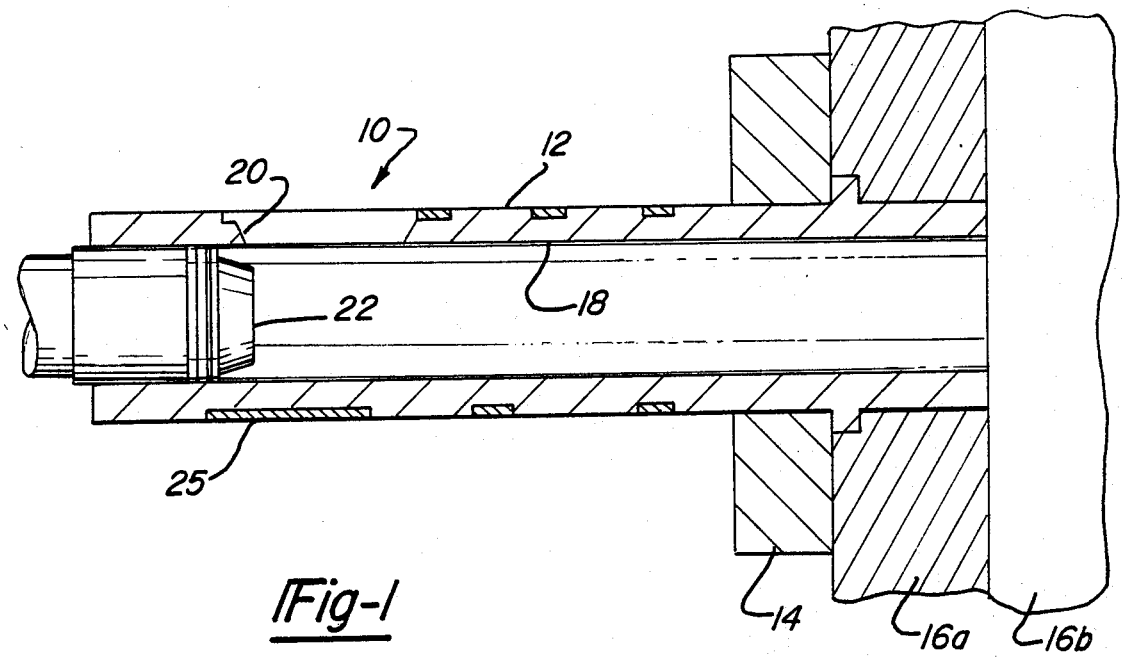
FIG. 1 is a side view of one embodiment of the invention shot tip positioned in a shot sleeve.

Referring first to the shot tip embodiment of FIGS. 1–4, the invention is embodied in an injector 10 for molten metal comprising a cylindrical shot sleeve 12 mounted in a platen 14 and projecting into the ejector portion **16*a* of the casting die 16*a*,16*b*. Sleeve 12 is provided with a hollow interior bore 18 which is loaded with molten metal by way of a radial opening 20 to form what is known in the art as a well. A ram, commonly called a shot tip 22, is tightly mounted within the bore 18 and functions to drive the molten metal into the cavity or mold 16 on command. Simple power means such as a hydraulic cylinder are connected to the shot tip 22 as will be apparent to those skilled in the injection molding arts. As is more fully disclosed in copending application Ser. No. 834,590, filed on Feb. 28, 1986, the sleeve 12 may include a spiral pattern 25 of copper, fused such as by welding or brazing into a shallow spiral groove extending from the well area toward the clamped end of sleeve 12 to distribute heat from the well area along the length of sleeve 12 to help prevent molten metal in the sleeve 12** from forming a tin can or frozen shell along the sleeve wall.

Figure 2:
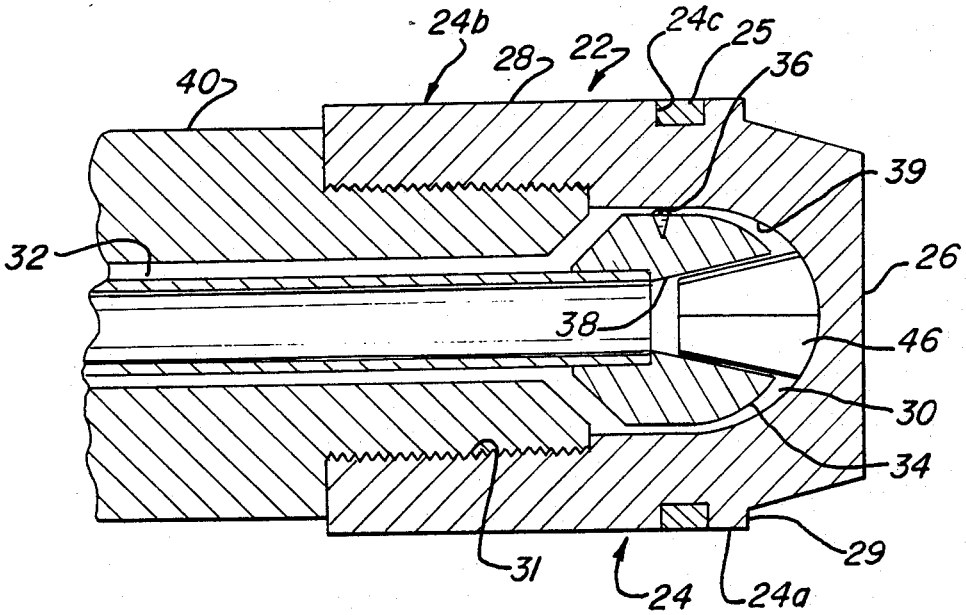
FIG. 2 is a fragmentary cross-sectional view of the shot tip of FIG. 1.
Figure 3:
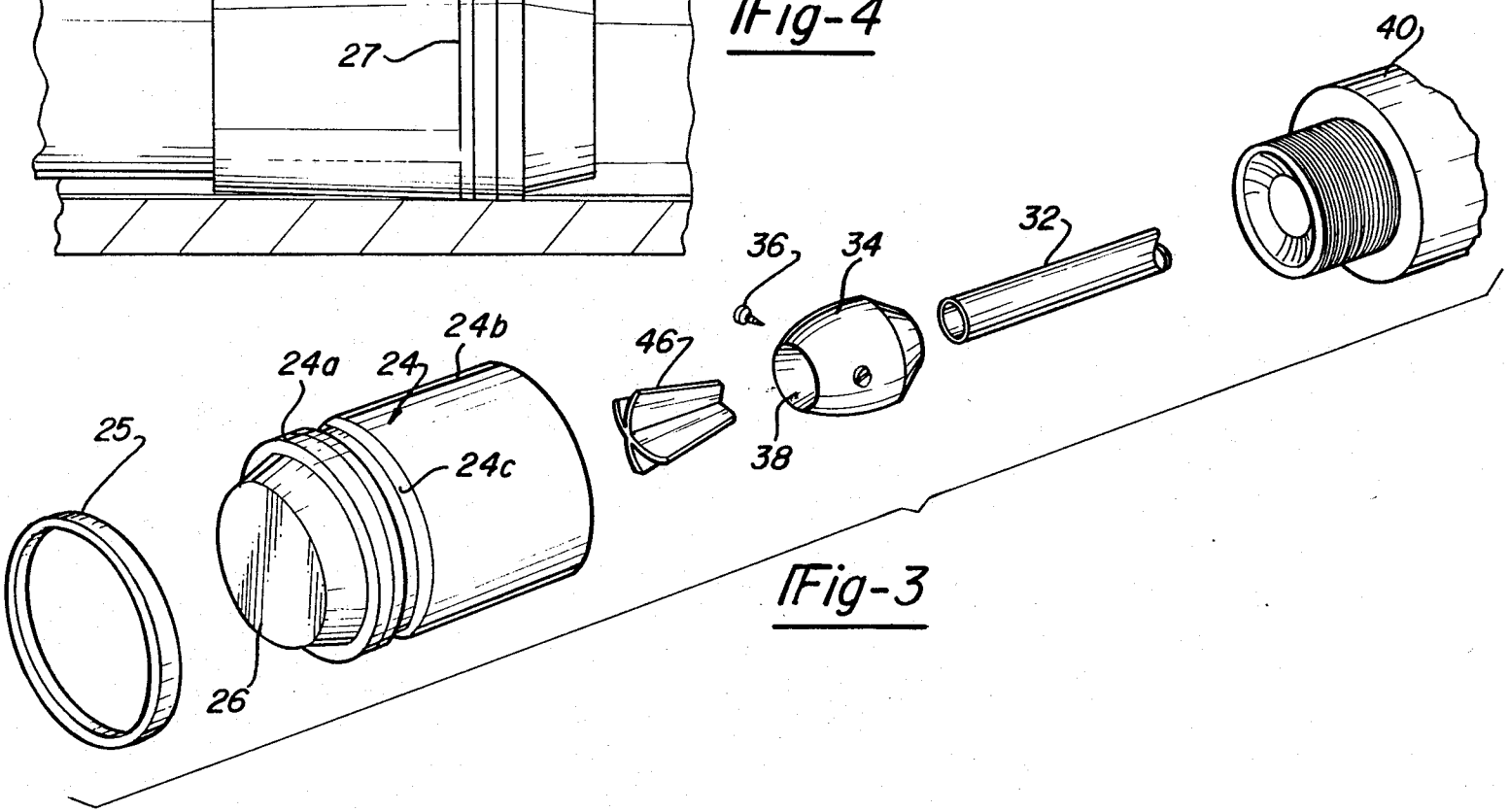
FIG. 3 is an exploded perspective view of the shot tip of FIG. 1.
Figure 5:
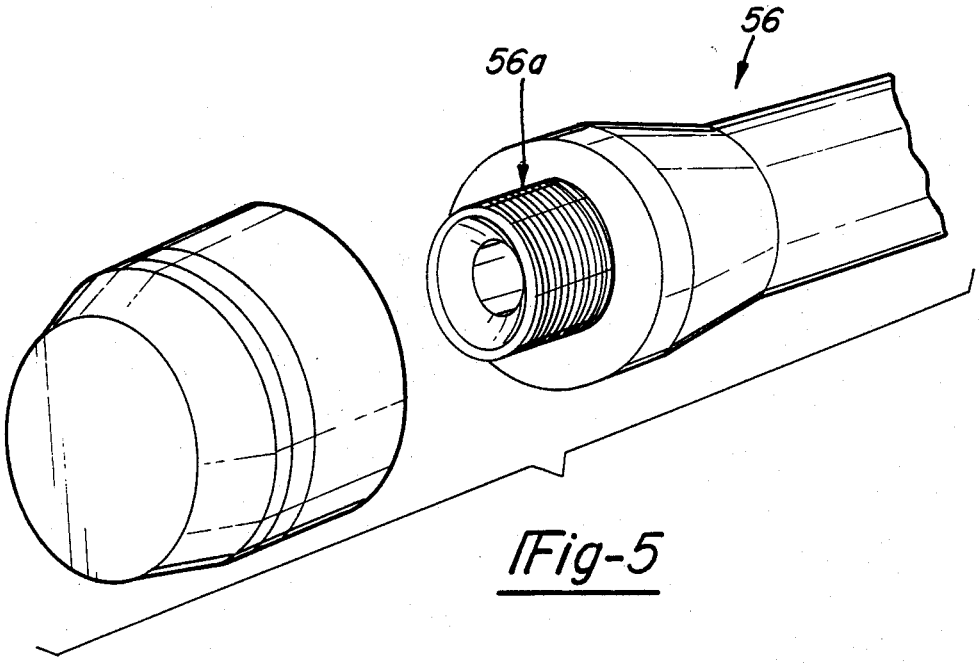
FIG. 5 is a perspective exploded view of another embodiment of the invention shot tip.
Figure 6:
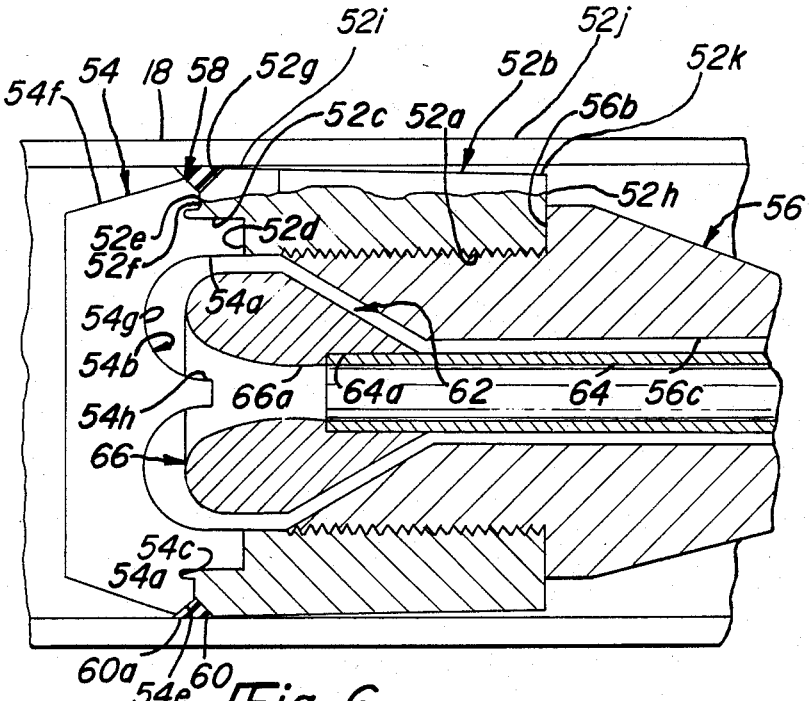
FIG. 6 is a longitudinal cross-sectional view of the shot tip of FIG. 5.
Figure 7:
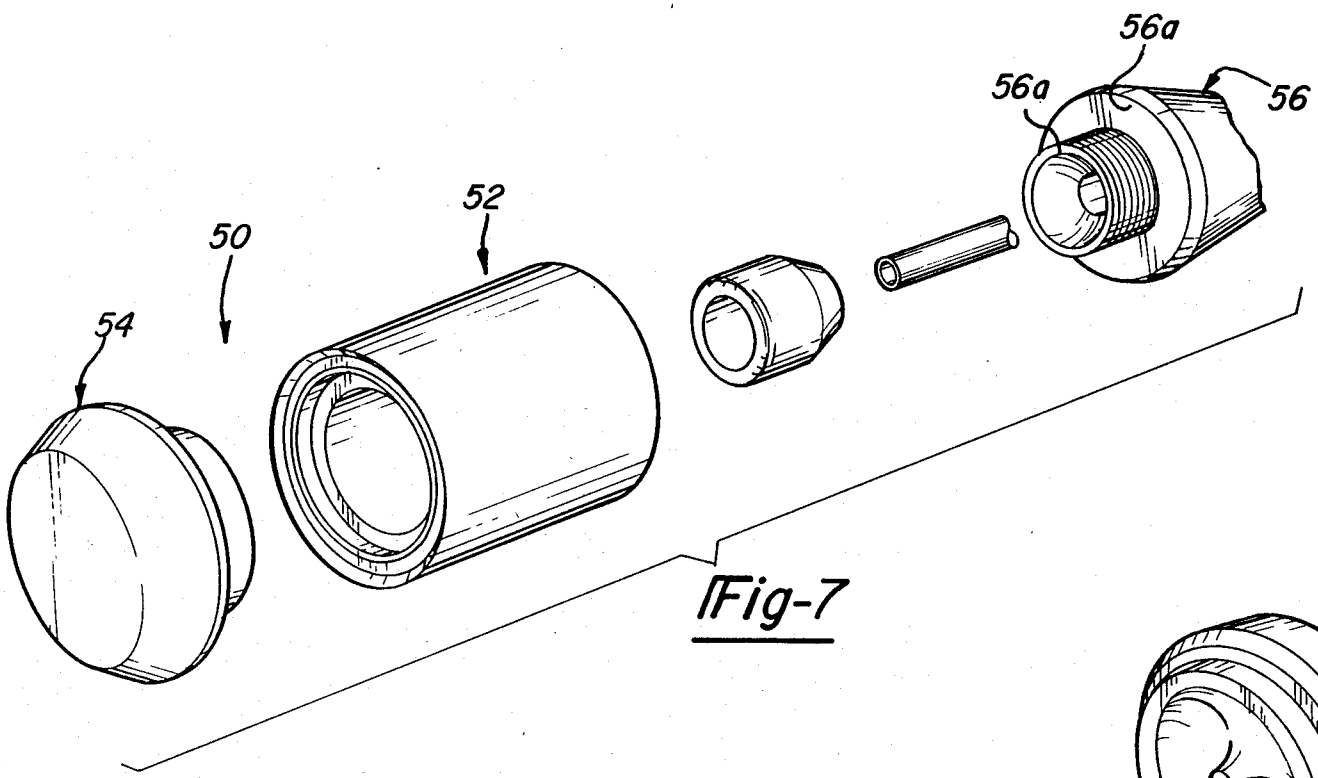
FIG. 7 is a further exploded perspective view of the shot tip of FIG. 5.
Figure 8:
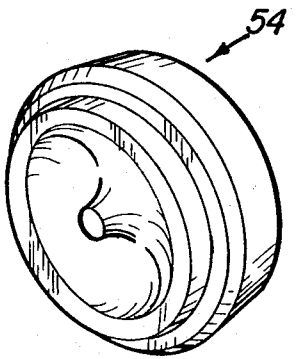
FIG. 8 is a perspective view of a front end piece utilized in the shot tip of FIG. 5.

Referring now specifically to FIGS. 2 and 3, the shot tip 22 comprises a pure copper head 24 having a substantially cylindrical peripheral surface which mates with the interior bore 18 of shot sleeve 12 as depicted in FIGS. 1 and 5. The head 24 is characterized physically by a domed front wall 26 which protrudes axially from the cylindrical peripheral wall 28. The dome wall recedes to a shoulder or stepped surface 29 which lies, in the case of a 4 inch length tip, about one inch longitudinally rearward of the wall 26. The forward facing area of stepped surface 29 is on the order of 6% of the total frontal area of the tip 22 contacting molten material. Accordingly, most heat from the material is absorbed into the protruding nose or dome of tip 22 ahead of surface 29, reducing thermal expansion of the tip adjacent surface 29 and reducing wear as the tip 22 slides within the sleeve 12.

Head 24 includes a relatively large diameter front end portion **24*a* and a relatively small diameter rear end portion 24*b*. Relatively large diameter front end portion 24*a* may have an axial extent, for example, of 0.6 inches in the case of a tip having a 4 inch length and a 3 inch nominal diameter. A circumferential groove 24*c* is provided in front end portion 24*a* rearwardly of shoulder 29 and a steel ring 25 is positioned within groove 24*c*. Groove 24*c* has an axial length of 0.25 inches. Steel ring 25 is preferably hardened to R/C 50 and has an axial length of 0.25 inches so as to fit snuggly within groove 24*c*. Steel sleeve 25 is preferably securely positioned within groove 24*c* by brazing and has a thickness relative to the depth of groove 24*c* such that its outer periphery is flush with the adjacent cylindrical surface of front end portion 24*a* or slightly inset with respect to that surface. For example, ring 25 may be provided in split form, slipped over of the shot tip for insertion into groove 24*c***, closed up so that it is equal to or slightly less than the diameter of the adjacent shot tip surface, and then brazed together so that it is precluded from expanding at the split.

The area rearwardly of front end portion **24*a* tapers inwardly toward the rear end of the shot tip to define the reduced diameter rear end portion 24*b*. For example, the shot tip may taper inwardly by 0.025 inches along each side from a line 27 at the rear end of front end portion 24*a* to the rear end 33 so that the diameter of the shot tip at rear end 33 is 0.050 inches less than the diameter of front end portion 24*a***. The described steel ring and copper body construction allows the head of the shot tip to be machined from solid copper bar stock rather than cast from a beryllium copper alloy.

Head 24 is hollowed out to provide an internal coolant chamber or hollow 30, the lefthand portion of which is provided with internal threads 31 to engage with the external mating threads of a plunger body 40. A tube 32 extends axially into the hollow within head 24 to form a first coolant flow path between the external surface of the tube 32 and the interior surfaces of head 24 and plunger body 40. Tube 32 defines a second coolant path within the tube 32 itself. The first flow path is inbound, and the second flow path is outbound, and these flow directions are important to the operation of the device as hereinafter described.

Because of the higher strength of the dome wall 26 relative to a flat wall or the like, the wall thickness in the area of the dome face may be reduced relative to prior art devices thereby to enhance thermal exchange between the coolant water and molten metal through the physical structure of the head 24 and to reduce thermal expansion of the head with resulting wear.

A baffle element 34 of aluminum is disposed within the internal chamber 30 of the head 24 and is configured to conform generally to the walls of the chamber 30 but is slightly smaller so as to be held in spaced relationship with the chamber walls by means of three spacer screws 36 arranged at 120 degree intervals. Baffle 34 is mounted on the exterior end of the tube 32 and has a flaring through-bore 38 in fluid communication with the tube 32. As coolant flow tends to center the baffle 34, screws 36 may be eliminated in most cases.

In essence, the baffle 34 causes the inbound coolant to flow along and in contact with the walls of hollow or chamber 30 for maximum cooling efficiency. Spacing between baffle 34 and internal wall 39 is selected to slow the coolant rate down to about 10 feet per second for optimum cooling. A deflector 46 has orthogonal vanes configured to conform generally to the through-bore 38 and is mounted within through-bore 38. The righthand end of deflector 46, as shown in FIG. 2, extends into contact with the surface of chamber 30 and serves to direct the coolant flow into the mouth of baffle 34 and thence into the tube 32 by which it is exhausted.

Figure 4:
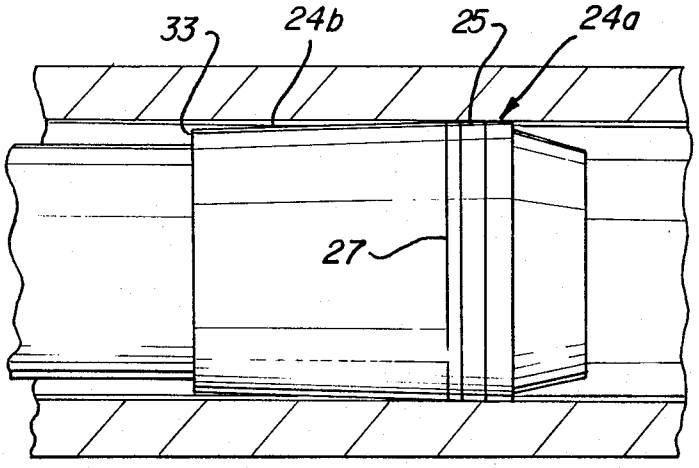
FIG. 4 is a fragmentary enlarged view of the shot tip of FIG. 1 positioned in a shot sleeve.

In operation, the shot tip 22 is assembled as previously described and placed into shot sleeve 12 as seen in FIGS. 1 and 4. Coolant water is directed inwardly along a path which lies between the tube 32 and the interior surfaces of the elements 24,40. The baffle 34 directs the cooling water radially outwardly so as to flow directly along the wall 39 toward the deflector 46 where a flow reversal occurs. Thereafter the coolant water enters the bore 38 of the baffle 34 and flows outwardly through conduit tube 32. The water is caused, by this arrangement, to suffer far less thermal shock and less vaporization than the arrangement of the prior art device wherein the water flows inwardly through the tube and impacts directly against the front wall of the shot tip. Also, since the deflector 46 is located at the hottest portion of wall 39, that is the portion where the most steam is generated during operation of the shot tip, any steam is instantly directed out of the coolant chamber 30 and into tube 32, preventing pressure buildup in the coolant chamber 30. Furthermore, the tube 32 is surrounded and cooled by the flow of coolant water in the coolant chamber 30. Steam directed into the tube 32 by deflector 46 condenses and loses volume, creating a vacuum or syphon which further assists in preventing pressure buildup in the coolant chamber 30. The relatively thin wall structure of the dome face 26 promotes thermal transfer from the molten metal to the cooling water and reduces thermal expansion of the head 24 at the forward portions.

Steel ring 25 is positioned immediately over and around the optimum chill zone of the shot tip so that the steel ring and the area of the head of the shot tip immediately surrounding the steel ring is effectively cooled to preclude any significant expansion in the diameter of either the steel ring or the adjacent material of the head of the shot tip. Because of the effective cooling provided by the invention shot tip, the shot tip can be sized to fit snuggly within the shot sleeve without danger of the shot tip binding within the shot sleeve as a result of expansion of ring 25 or of the head of the shot tip resulting from excessive heating of the front end portion of the shot tip. For example, for a shot tip having a 3 inch diameter at the front end portion and given a steel coefficient of expansion of 0.000011, the increase in temperature at the steel ring must be held to less the 33 degrees Fahrenheit if the shot tip is to run with the desired 0.001 inch clearance between the sleeve and shot tip and not bind up or drag in the sleeve. The invention cooling system is capable of maintaining the increase in temperature of the steel ring within this range so that the novel cooling arrangement of the invention shot tip in combination with the steel ring operating in a relatively small axial length sealing interface allows the invention shot tip to be precisely matched to the internal diameter of the shot sleeve and ensures that the shot tip will function effectively and without binding or dragging in the shot sleeve over extended periods of use. The steel ring also functions to remove solder attached to the inside wall of the shot sleeve, thereby further adding to the efficient operation and durability of the invention shot tip. The steel ring allows the axial length of the sealing diameter to be minimized and thereby enables the rear end of the shot tip to be reduced so as to concommittantly reduce drag, and further enables the main body of the shot tip to be formed of pure copper, thereby significantly reducing the cost of the shot tip as compared to prior art shot tips requiring the use of much more expensive beryllium copper. The pure copper content of the main body of the steel tip also improves the heat conductivity of the shot tip.

With reference now to the shot tip embodiment of FIGS. 5–8, the shot tip 50 of the FIGS. 5–8 embodiment is formed of two pieces including a main body section 52 and a front end section 54.

Main body section 52 is formed of steel and has a generally cylindrical configuration with a threaded central bore 52*a*, a generally cylindrical outer surface 52*b*, a counter bore 52*c* forming a shoulder 52*d* with central bore 52*a*, an annular front face 52*e*, an annular lip or bead 52*f* at the juncture of counterbore 52*c* and annular face 52*e*, and an annular chamfered surface 52*g* extending between front face 52*e* and outer surface 52*b*. Threaded central bore 52*a* is sized to screw onto the threaded hub portion 56*a* of a plunger 56 with the rear annular face 52*h* of the main body section abutting against a shoulder 56*b* on the plunger. Main body section 52 includes a front end portion 52*i* and a rear end portion 52*k*. Front end portion 52*i* has a cylindrical configuration having a diameter slightly less than the diameter of shot sleeve 18 so as to fit snuggly but slidably within the shot sleeve and rear end portion 52*j* is conical and tapers inwardly toward the rear end of the main body section so as to form a loose fit with the shot sleeve 18 at the rear end diameter 52*k* of the body section.

Front end section 54 is formed of pure copper and has a generally disk shaped configuration. Section 54 is fitted onto the front end of main body section 52 with an annular hub portion 54*a* on the rear face 54*b* of the section fitted into counterbore 52*c* on the main body section, an annular groove 54*c* receiving bead 52*f*; an annular surface 54*d* abutting main body front face 52*e*; and a chamfered annular surface 54*e* coacting with main body surface 52*g* to define an annular chamfered V-shaped trough or groove 58 extending around the shot tip head at the interface of the main body section and the front end section.

The front end section is rigidly secured to the main body section by a weld ring 60 positioned within trough 58. Weld ring 60 may be formed of a copper alloy such as Amco. Weld ring 60 is finished to have a cylindrical outer surface 60*a* flush with the cylindrical surface of front end portion 52*i* of the main body section so that weld ring 60 forms a forward continuation of annular surface 52*i* and fits sealingly and snuggly within the shot sleeve 18. The conical surface 54*f* at the front end of section 54 is undercut with respect to the forward section of weld ring 60.

Main body section 52 and front end section 54 coact to define an internal cooling chamber 62. A tube 64 extends axially within a central bore 56*c* within the plunger body and opens at its front or inlet end 64*a* in chamber 62. As with the embodiment of FIGS. 1–4, tube 64 coacts with plunger body 56 at the head of the shot tip to define a first coolant path between the external surface of the tube and the interior of central bore 56*c* and a second coolant path within the tube 64 itself. The first flow path is inbound, and the second flow path is outbound.

A baffle element 66 of aluminum is disposed within chamber 62 and is configured to generally conform to the walls of the chamber but is slightly smaller so as to be held in spaced relationship with the chamber walls. Baffle 66 is mounted on the front or inlet end of tube 64 and has a flaring central throughbore 66*a* in fluid communication with the interior of tube 64. The rear face 54*b* of front end section 54 is configured to provide an annular, concave surface 54*g*, and a central conical rearwardly projecting portion 54*h* projecting into the central bore 66*a* of baffle element 66 and acting as a deflector to deflect coolant rearwardly and inwardly through bore 66*a* into tube 64.

The shot tip of the FIG. 5–8 embodiment, as with the embodiment of FIGS. 1–4, provides a minimal axial interface as between the tip head and the sleeve so as to preclude binding and provides a wear resistant surface at the interface to preclude blowby of molten metal. The wear-resistant surface is provided by the large diameter front end portion 52*i* of the steel main body section as well as by the outer circumferential surface 60*a* of the copper alloy weld ring. Additionally, the embodiment of FIGS. 5–8 provide substantial economies of construction and also permits the head to be readily reconstructed after it wears out. The head of the FIGS. 5–8 embodiment further allows an improvement in the configuration of the cooling chamber defined within the head and, specifically, allows the deflector member positioned within the central bore of the baffle member to be constituted by an integral rearwardly projecting portion of the head rather than being provided by a separate element.

Whereas preferred embodiments of the invention have been illustrated and described in detail, it will be apparent that various changes may be made in the disclosed embodiments without departing from the scope or spirit of the invention.

I claim:

1. A shot tip for use in a shot sleeve comprising:

(A) an elongated plunger having a front end; and (B) a generally cylindrical, unitary head, rigidly secured to said front end of said plunger and including a front body region, a main body region and a rear body region, the main body region having a cylindrical exterior configuration of relatively large, substantially constant diameter to form a relatively tight fit with the shot sleeve, the front body region being disposed forwardly of said main body region and having a diameter less than the diameter of said main body region, and the rear body region being disposed rearwardly of said main body region, the diameter of said rear body region being tapered radially inwardly in a direction opposite the main body region so as to form a relatively loose fit with the shot sleeve.

2. A shot tip according to claim 1 wherein the head further comprises a step surface disposed between said front body region and said main body region formed on the periphery of said head.

3. A shot tip according to claim 1 further including a wear ring circumferentially disposed around said main body region.

4. A shot tip as in claim 1, wherein said front body region has a frusto-conical configuration.

5. A shot tip as in claim 3, wherein said wear ring is formed of a wear resistant material, different from the material of said shot tip head.

6. A shot tip according to claim 3 wherein:

said shot tip head is formed of a soft highly conductive material;

an external circumferential groove is formed in said main body region; and said ring comprises a ring member of relatively hard material positioned in said groove in generally flush relation to the surrounding surface of said main body region.

7. A shot tip according to claim 3 wherein:

said shot tip head is formed of copper and said wear ring is formed of steel.

8. A shot tip according to claim 3 wherein:

the diameter of said rear body region tapers radially inwardly in a direction opposite said wear ring.

9. A shot tip for use in a shot sleeve comprising:

(A) an elongated plunger;

(B) a head rigidly secured to the free, front end of said plunger and including a main body section having a generally cylindrical configuration with a front end portion of relatively large diameter forming a relatively tight fit with the shot sleeve and a rear end portion of relatively small diameter forming a relatively loose fit with the shot sleeve; and (C) cooling means including an internal chamber in said head, a coolant exhaust tube extending into said chamber but spaced from the walls of said chamber and having an inlet within said chamber, and flow directing means disposed within said chamber and operatively associated with said tube for directing inbound coolant over the outside surface of said tube, along the walls of said chamber, and into the inlet end of said tube.

10. A shot tip according to claim 9 wherein said flow directing means disposed within said chamber comprises a baffle member mounted on the inlet end of said tube and having a through-bore in fluid communication with the interior of said tube, said baffle member being externally of greater diameter than said tube for directing coolant flowing into said chamber outwardly against the inner surfaces of said chamber.

11. A shot tip according to claim 10 wherein said flow directing means further includes a deflector mounted in said bore of said baffle member to direct coolant into said bore of said baffle.

12. A method of minimizing binding of a shot tip in a shot sleeve while maintaining effective sealing as between the tip and the sleeve over extended periods of usage, said method comprising the steps of:

forming the tip so as to define a generally cylindrical, unitary shot tip head, said head including a front body region, a main body region and a rear body region, the main body region having a cylindrical exterior configuration of relatively large diameter and said rear body region being tapered radially inwardly in a direction opposite the main body region; and positioning a ring of relatively hard material in flush relation in the exterior circumference of said relatively large diameter main body region.

13. A method according to claim 12 wherein said tip is formed of pure copper and said ring is formed of steel.

14. A method according to claim 12 wherein said method includes the further step of cooling said tip in the region of said ring by passing a cooling liquid forwardly through said rear body region and into a chamber formed in said main body region and said front body region.

15. A shot tip for use in a shot sleeve comprising:

(A) a head having a central bore and an enlarged coolant chamber forwardly of said bore defined by the forward wall of said head and a circumferential wall of said head;

(B) a coolant exhaust tube positioned within said central bore and extending forwardly into said chamber but spaced from the walls of said chamber and having a front, inlet end within the chamber;

(C) a baffle member mounted on the front inlet end of the tube and having a through-bore in fluid communication with the interior of said tube, said baffle member being externally of greater diameter than the tube for directing coolant flowing into the chamber outwardly against the interior surfaces of the chamber; and (D) a deflector formed integrally with said forward head wall and extending rearwardly into the bore of said baffle to direct coolant into the bore of the baffle member.

16. A shot tip according to claim 15 wherein:

(E) said head is formed of two separate pieces including a main body section and a front end section;

(F) said front end section defines said forward wall of said head and said deflector extends centrally and rearwardly from the rear face of said front end section into said baffle member bore.

17. A shot tip according to claim 16 wherein:

(G) said front end section is secured to said main body section by an external circumferential weld ring.

18. A shot tip according to claim 17 wherein:

(H) said main body section is formed of steel, said front end section is formed of copper, and said weld ring is formed of a copper alloy.

* * * * *